US005379490A

United States Patent [19]

Wandt et al.

[11] Patent Number: 5,379,490

[45] Date of Patent: Jan. 10, 1995

[54] BELT CLIP ASSEMBLY

[75] Inventors: Henry Wandt, Boca Raton; Gerald E. Brinkley, West Palm Beach, both of Fla.

[73] Assignee: Motorola, Schaumburg, Ill.

[21] Appl. No.: 335

[22] Filed: Jan. 4, 1993

[51] Int. Cl.[6] ..... A45F 5/02

[52] U.S. Cl. ..... 24/3 J; 24/3 L; 24/511; 224/252

[58] Field of Search ..... 24/3 J, 3 L, 3 F, 3 E, 24/3 H, 3 R, 511, 507; 224/252, 269

[56] References Cited

U.S. PATENT DOCUMENTS 1,070,403 8/1913 Bryant ..... 24/511
1,314,392 8/1919 Glamzo ..... 224/252
2,609,980 9/1952 Morgenstern ..... 224/252
4,536,925 8/1985 Boothe et al. ..... 24/511
4,828,153 5/1989 Guzik et al. ..... 224/269
4,956,895 9/1990 Hayasaka ..... 24/3 J
5,261,583 11/1993 Long et al. ..... 24/3 L

*Primary Examiner*—Richard A. Bertsch
*Assistant Examiner*—Roland G. McAndrews, Jr.
*Attorney, Agent, or Firm*—Pablo Meles; John H. Moore

[57] ABSTRACT

A belt clip assembly (10) comprises a hook shaped feature (18 and 20) having a void (17) and which appends from a housing (12), a latch member (14 and 15) pivotably retained within the void of the hook shaped feature, and a spring (30) for biasing a bottom portion (15 and 16) of the latch member in a closed position against the housing.

16 Claims, 1 Drawing Sheet

BELT CLIP ASSEMBLY

TECHNICAL FIELD

This invention relates generally to belt clip assemblies and in particular, to a belt clip assembly allowing for ease of removal from a belt.

BACKGROUND

Typical belt clip assemblies for portable electronic products provide for the adequate retention of the portable electronic product to a belt or similar garment. Unfortunately, in providing adequate assurance in the security of the product to the belt, a common problem exists in the form of the awkward removal of the portable product from the belt. Most belt clips have a latch with a hook on the bottom portion of the latch. The hook on the bottom of the latch is generally necessary to provide adequate assurance that the portable product will not fall off the belt. When a user attempts to remove the portable product from their belt, the hook on the latch portion of the belt clip assembly will typically cling on to the belt. The user is then required to use extra effort to remove the portable product by putting their fingers between their belt and the waist band area of their pants or skirt to allow the hook to disengage from the belt. Thus, a belt clip assembly for portable products is desired that allows for the ease of removal from belts or similar garments.

SUMMARY OF THE INVENTION

A belt clip assembly comprises a hook shaped feature having a void which appends from a housing, a latch member pivotably retained within the void of the hook shaped feature, and a spring for biasing a bottom portion of the latch member in a closed position against the housing.

DETAILED DESCRIPTION OF THE PREFERRED EMBODIMENT

Figure 1:
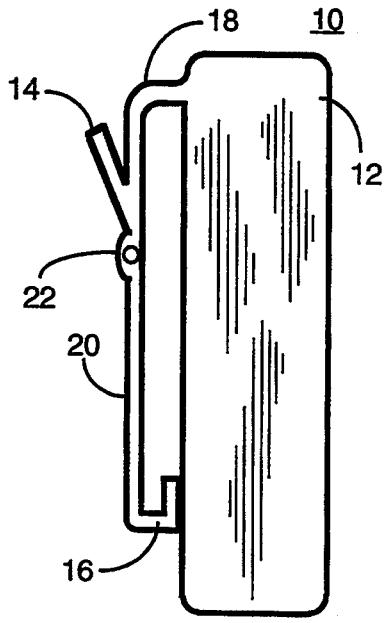
FIG. 1 is a side view of a portable electronic product having a belt clip assembly in accordance with the present invention.
Figure 2:
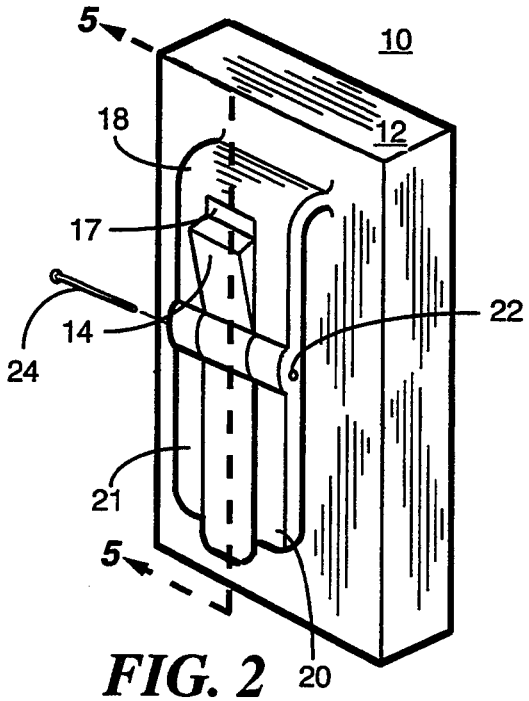
FIG. 2 is a perspective view of a portable electronic product having a belt clip assembly in accordance with the present invention.

Referring to FIGS. 1 and 2, there is shown a side view and a perspective view respectively of a portable electronic product such as a selective call receiver or pager or two-way radio having a belt clip assembly 10 in accordance with the present invention. Preferably the belt clip assembly comprises hook shaped feature 18 that integrally appends from a housing 12. Alternatively, the hook shaped feature can be removably detachable from the housing 12. The hook shaped feature preferably extends vertically downward providing first and second hook arm members (20 and 21) that are spaced apart thereby forming a void 17 in the hook shaped feature. The belt clip assembly 10 further includes a latch member 14 pivotably retained between the first and second hook arm members 20 and 21. The latch member 14 is preferably retained using a pin 24 set through an opening in 22 in both the hook arm members and the latch member. Alternatively, the latch may be designed to snap into place between the hook arm members. Additionally, the latch member preferably has a bottom portion 15 (see FIG. 3) with a upward turned hook 16 so as to provide a closed-loop area for added security.

Figure 3:
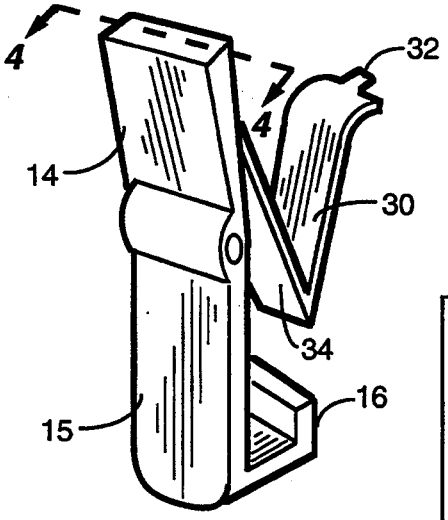
FIG. 3 is a perspective view of a latch member and spring means of a belt clip assembly in accordance with the present invention.
Figure 4:
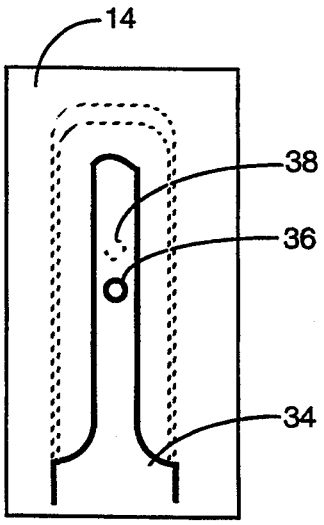
FIG. 4 is a rear cut view along line 4—4 of the latch member and spring means of FIG. 3.
Figure 5:
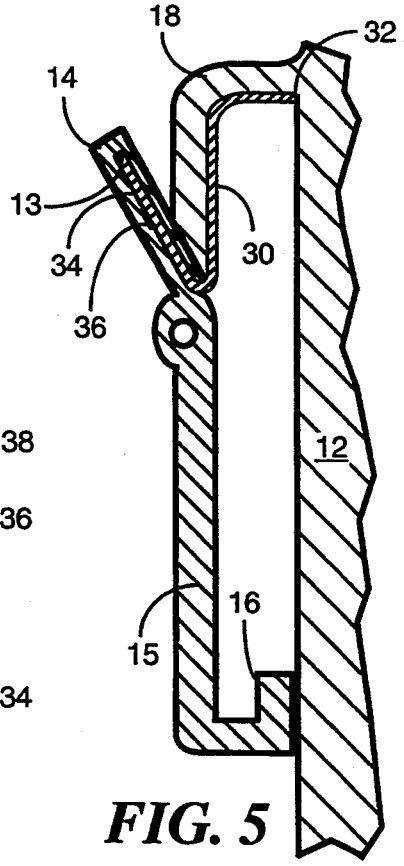
FIG. 5 is a cross-sectional view along line 5—5 of FIG. 2.

Referring to FIG. 3, there is shown a perspective view of the latch member 14 and a spring means 30 in accordance with the present invention. The spring means 30 preferably comprises a leaf spring having a substantially V-shape configuration, although other configurations for spring means 30 would be within contemplation of the present invention. The spring means 30 preferably biases the latch member 14 towards the housing 12. Now referring to FIGS. 3, 4, and 5, the leaf spring 30 has a member 34 which is preferably inserted into a slot 13 in the latch member 14. Additionally, the leaf spring 30 includes a housing key or retaining feature 32 that allows the spring to be secure with the housing 12. Optionally, the member 34 can have a detent feature 36 that can mate with a depression 38 in the latch member 14 to secure the leaf spring 30 to the latch member 14 with slot 13 with greater confidence.

In operation, the belt clip assembly of the present invention allows a user to depress the latch member 14 and displace the hook 16 from the hook arm members 21 and 22 to provide easy engagement and disengagement of the belt clip assembly from a belt or similar garment. The hook arm members 21 and 22 do not have upward turned hooks as found on the separate latch member 14. Thus, with the hook 16 on latch member 14 displaced away from the hook arm members, the belt clip assembly 10 does not cling to a belt when attempting to remove it.

Although the invention has been described with reference to a specific embodiment, it is to be understood that numerous other arrangements in accordance with the present invention may readily be devised by those skilled in the art without departing from the spirit and scope of the invention.

What is claimed is:

1. A belt clip assembly, comprising:

a hook shaped feature having a void, said hook shaped feature appending from a housing;

a latch member which i$ pivotably retained within said void of the hook shaped feature using complementing snap fit features in the latch member and the hooked shaped feature; and spring means for biasing a bottom portion of the latch member in a closed position against the housing, wherein the bottom portion of the latch member is oriented towards the bottom of the housing.

2. The belt clip assembly of claim 1, wherein said hook shaped feature is integrally formed into said housing and appends downward from a top portion of the housing.

3. The belt clip assembly of claim 2, wherein the latch member is pivotably retained within the void between the hook shaped feature using a pin, said latch member having a hook appending upward from the bottom portion of the latch member.

4. The belt clip assembly of claim 1, wherein said spring means comprises a leaf spring.

5. The belt clip of claim 4, wherein a portion of the leaf spring inserts into a slot within a top portion of the latch member.

6. A belt clip assembly, comprising:

a housing;

first and second hook arm members appending from the housing, said second hook arm member being spaced apart from said first hook arm member;

a latch member which is pivotably retained between said first and said second hook arm members using complementary snap fit features in the latch member and the hook arm members;

spring means for biasing a bottom portion of the latch member in a closed position against the housing, wherein the bottom portion of the latch member is oriented towards the bottom of the housing.

7. The belt clip assembly of claim 6, wherein said first and said second hook arm members are integrally formed into said housing.

8. The belt clip assembly of claim 6, wherein the latch member is pivotably retained between the first and the second hook arm members using a pin.

9. The belt clip assembly of claim 6, wherein said spring means comprises a leaf spring.

10. The belt clip of claim 9, wherein a portion of the spring means inserts into a slot within a top portion of the latch member.

11. A portable electronic product having a belt clip assembly, comprising:

a housing for the portable electronic product;

a hook shaped feature having a void appending integrally from a housing;

a latch member pivotably retained within said void of the hook shaped feature; and a leaf spring for biasing a bottom portion of the latch member in a closed position against the housing, wherein the bottom portion of the latch member is oriented towards the bottom of the housing and the leaf spring inserts into a slot within a top portion of the latch member.

12. The belt clip assembly of claim 11, wherein said hook shaped feature is integrally formed into said housing.

13. The belt clip assembly of claim 11, wherein the latch member is pivotably retained within the void using a pin.

14. The belt clip of claim 11, wherein a detent feature within the slot of the latch member retains the leaf spring within the slot.

15. The belt clip assembly of claim 11, wherein the latch member is pivotably retained within the void using complementing snap fit features in the latch member and the hooked shaped feature.

16. The electronic product of claim 11, wherein said electronic product comprises a selective call receiver.

* * * * *